United States Patent [19]

Delo et al.

[11] 4,052,227

[45] Oct. 4, 1977

[54] PARTS WASHER

[75] Inventors: William A. Delo, Wyoming; Raymond J. Nielsen, Saranac, both of Mich.

[73] Assignee: 4 - Share, Inc., Grand Rapids, Mich.

[21] Appl. No.: 615,224

[22] Filed: Sept. 22, 1975

[51] Int. Cl.[2] ..... B08B 3/02

[52] U.S. Cl. ..... 134/56 R; 134/111; 134/113; 134/200; 312/229

[58] Field of Search ..... 134/56 R, 104, 110–111, 134/113, 92, 117, 200–201; 49/1, 2; 312/228, 229

[56] References Cited

U.S. PATENT DOCUMENTS

| | | | |
|---|---|---|---|
| 2,653,617 | 9/1953 | Zaber | 134/56 R |
| 2,827,003 | 3/1958 | Stetson | 49/1 X |
| 3,343,555 | 9/1967 | Kasner | 134/111 |
| 3,352,310 | 11/1967 | Doyscher | 134/56 R |
| 3,362,139 | 1/1968 | Williamson | 134/110 X |
| 3,378,019 | 4/1968 | Riolo et al. | 134/111 |
| 3,522,814 | 8/1970 | Olson | 134/111 |
| 3,771,539 | 11/1973 | De Santis | 134/111 |
| 3,890,988 | 6/1975 | Lee | 134/104 X |
| 3,921,653 | 11/1975 | Ducharme | 134/111 X |

*Primary Examiner*—Robert L. Bleutge

*Attorney, Agent, or Firm*—McGarry & Waters

[57] ABSTRACT

A parts washer having a tub, a cylindrical drain in the tub and a cover hinged to the tub so as to cover the tub when the cover is lowered. A novel overcenter linkage is mounted at one end in the sink and at the other end on the cover to hold the cover in a raised position as desired. The linkage has at least one link and preferably multiple links which are fusible at relatively low melting points such that the fusible link or links will melt quickly if a fire occurs in the tub. A solvent receptacle is pivotably mounted beneath the tub and has a drain opening at a side for quickly and easily draining and replacing the solvent used in the system. A splash plate extends above a back wall of the tub and covers the joint between the back wall and the cover to keep splashed solvent from leaking down behind the cover. A cylindrical drain tube depends from the bottom wall of the tub and has an open top into which is placed a compressible open-cell foam material for filtering the solvent which passes therethrough. A compressible closed-cell foam material is removably positioned in the drain tube above the open-cell filter material in compressed condition so as to block the flow of fluid through the drain tube as desired.

14 Claims, 2 Drawing Figures

PARTS WASHER

BACKGROUND OF THE INVENTION

1. Field of the Invention

This invention relates to parts washers. In one of its aspects, the invention relates to a parts washer having an overcenter fusible linkage for holding the cover in place during normal operation but to quickly release the cover in the event of fire. In another of its aspects, the invention relates to a parts washer having an improved drain and filter. In still another of its aspects, the invention relates to a parts washer having an improved solvent receptacle which is easily cleaned and drained. 2. State of the Prior Art Industrial parts washers have been used for many years in automotive and other types of repair shops. Such washers include a sink with a hinged cover which is released in the event of fire to cover the sink. Further, a solvent container is positioned beneath the sink to hold the solvent when cleaning the parts and a filter-containing drain is provided beneath the sink and the solvent container. A pump is provided in the solvent container to pump liquid to the sink as desired for washing the parts.

Typically, the solvent container is an oil drum on which the sink rests. Such parts washers are disclosed in the U.S. Pat. Nos. to Olson, 3,522,814, and to Palmer, 2,897,830. Such solvent containers, while being relatively inexpensive, tend to provide unstable supports for the sink.

The hinged covers of the parts washers are held in position by a chain, which extends from the back of the cover. A fusible link extends through the cover and connects the chain to the cover. The fusible link melts when heated, for example, by a fire. Such fusible link systems, which are disclosed in the aforementioned U.S. Pat. to Olson and in the U.S. Pat. to Riolo et al, 3,378,019, provide the linkage relatively high above the sink and close to the cover. As a result, some critical moments pass before the fusible link reaches the proper fusion temperature.

In the parts washers known heretofore, the solvent removal and replacement have been of some concern. In the types of washers in which inexpensive drums are used as supports for the sink, solvent changing is cumbersome and awkward. In many cases, the sinks must first be removed and the drains dumped and refilled. In other parts washers, for example in the aforementioned United States patent to Riolo et al and in the U.S. Pat. to Albertson, NO. 2,438,654, the solvent container contains some special pumps or filters, and makes removal of the solvent difficult without pumping it out of the container. If a pump is used, the residue and sludge may not be removed.

The filters used in the drains must also be readily accessible to remove the same for cleaning. Otherwise the filters tend to clog and become ineffective and draining becomes slow.

SUMMARY OF THE INVENTION

The parts washer according to the invention has a cover supporting linkage which is extremely easy to operate, yet extremely close to the solvent and will melt quickly so that the cover quickly covers the tub in the event of fire. Further, filter material in the drain is easily accessible for quick removal for cleaning purposes. In one embodiment, a novel pivotably mounted solvent container is provided for easy removal of the solvent and cleaning of the solvent container if desired.

According to the invention, the parts washer has a tub, a drain in the tub and a cover hinged to the tub so as to cover the tub when the cover is down. An overcenter linkage is provided for retaining the cover in the up position and for releasing the cover to a down position over the tub. The linkage has one end mounted within the tub and another end mounted on the cover. The linkage has one position bracing the cover in a raised position but slightly tilted forward over the tub and another position, permitting closure of the cover over the tub. The overcenter linkage has at least one fusible link which melts at a relatively low temperature such as that temperature caused by a fire within the tub so that the cover will fall over the tub.

The overcenter linkage is formed from a first linkage which is pivotably mounted at one end to a back wall of the tub and a second linkage pivotably secured at a lower end to an upper end of the first pivotable linkage and at the other end is pivotably mounted to the cover. Desirably, both first and second linkages are fusible at low temperatures and melt at a temperature of about 140° F.

A solvent receptacle is positioned beneath the tub and pivotally mounted thereto at one end portion of the tub. Means releasably secure the solvent receptacle in a substantially horizontal position beneath the tub. A drain plug is provided at the bottom portion of the solvent receptacle at an end opposite the pivotably mounted end whereby the solvent receptacle can be quickly and easily drained by removing the releasable retaining means and the drain plug.

A cylindrical drain tube depends from a bottom wall of the tub. The drain tube has an open top and at least one opening in the bottom thereof. A compressible and resilient, open-cell, soft foam material is removably positioned within the cylindrical tube and fills at least cross-sectional areas thereof so that the solvent is filtered as it passes through the drain tube. A compressible and resilient, closed-cell foam material is removably positioned in the drain tube above the open-cell filter material in compressed condition so as to block the flow of fluid through the drain tube as desired.

The pivotably mounted solvent receptacle has a bar positioned at each side of the rear thereof, the bar extending rearwardly of the solvent receptacle and having a hook which engages openings at a flange depending from the tub. A latch bar is slidably mounted at the upper front sides of the solvent container and slides between positions engaging and disengaging holes in a depending flange at the front of the tub.

BRIEF DESCRIPTION OF DRAWINGS

The invention will now be described with reference to the accompanying drawings in which.

DESCRIPTION OF THE PREFERRED EMBODIMENT

Figure 1:
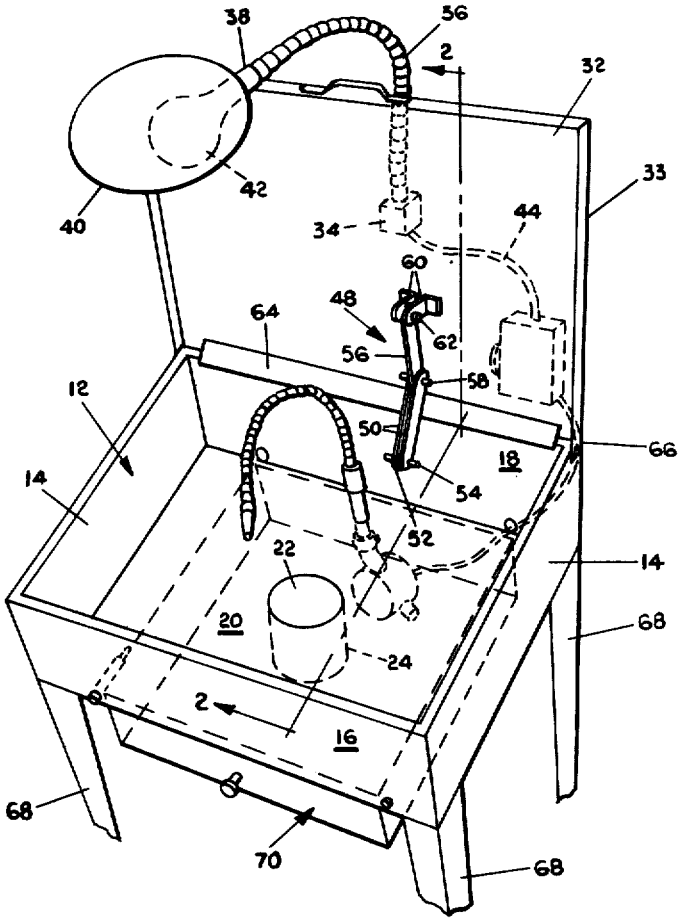
FIG. 1 is a top perspective view of a parts washer according to the invention.

Referring now to the drawings, there is shown a parts washer having a tub 12 formed of sidewalls 14, a front wall 16, a back wall 18, and a bottom 20. The tub 12 is supported on four legs 68 which are secured through suitable bolts to the bottom portions of the tub 12. A circular drain opening 22 having a depending cylindrical drain tube 24 is formed in the central portion of the bottom 20. A drain opening 26 is provided at the bottom of the drain tube to allow liquids to drain therefrom. A filter material 28 of a compressible open-cell foam is compressed and removably positioned within the drain tube so as to fill cross-sectional areas thereof. A drain plug of a closed-cell resilient material is removably positioned on top of the filter material to retain the liquid within the tub 12. Removal of the drain plug 30 allows any liquid in the tub to drain through the filter material which removes larger dirt and metal particles. The open-cell foam material can be any relatively porous compressible material which can be easily cleaned. A suitable material is a polyethylene foam sold under the trademark ETHAFOAM by the Dow Chemical Company.

A cover 32 is pivotably mounted to a back portion of the tub 12. The cover has a depending lip 33 around the sides and front portion so that the cover seals the tub when the cover is lowered over the top of the tub. A lamp bracket 34 is mounted on the back portion or top side of the cover 32. A flexible conduit 36 having a light socket at one end is mounted at the other end to the lamp bracket 34. A light shield 40 is mounted on the flexible conduit and a light bulb is positioned within the light socket. An electrical cord 44 extends from the light socket through the flexible conduit and to an electrical outlet box 46 which is mounted on the back or top side of the cover 32.

The cover 32 is mounted to the top 12 through bolts 66 which extend through the back end of sidewalls 14 and the back end of the cover lip 33.

A splash shield 64 is mounted at the upper portion of the back wall 18 and extends over the top surface thereof to prevent splashed liquids from washing down between the cover and the back wall 18.

An overcenter toggle linkage 48 of a fusible material is provided between the cover 32 and the tub 12 to hold the cover in the open position when the tub is being normally used and to allow the cover to close over the tub when the tub is not being used. Further, the overcenter linkage provides a means for automatically releasing the cover so that it closes over and seals the tub in the event of a fire.

The overcenter linkage 48 comprises a pair of low temperature fusible plastic links 50 which are pivotably mounted at a lower portion to a bracket 52 through bolt 54. Another low temperature fusible link 56 is pivotably mounted to the two plastic links 50 through a bolt 58. At the upper portion, the link 56 is pivotably mounted to a pair of brackets 60 through bolt 62. The brackets 60 in turn are secured by welding to the undersurface of the cover 32.

The plastic links 50 and 56 are made from a low temperature plastic material which melts at about 140° F. Suitable fusible material include low temperature thermoplastic materials such as polycarbonates, polyethylene, polypropylene and the like.

A solvent receptacle 70 comprising sidewalls 72, front wall 74, back wall 76 and a bottom wall 78 is mounted beneath the bottom wall 20 of the tub 12. The bottom wall 78 of the solvent receptacle 70 slopes downwardly to a low central point 80 for settling of dirt particles. A hinge bar 94 having a hook 96 is welded to the back of each side 72 of the solvent receptacle 70. Each of the hooks 97 extends through an opening at the lower portion of the back wall 18 of the tub 12 to pivotably mount the solvent receptacle 70 to a back portion of the tub 12. A pair of sleeves 100 are welded to the front portion of the sidewalls 72 of the tub 70. Bars 98 slide within the sleeves 100 and project at a front portion through openings at the bottom of the front wall 16 of tub 12. Cotter pins 102 extend through both bars 98 behind the front wall 16 to assist in sliding the bars back and forth. Circumferential grooves in the bars 98 at the front ends rest in the wall openings so that the solvent receptacle 70 is retained in the position shown during normal operation of the parts washer.

Figure 2:
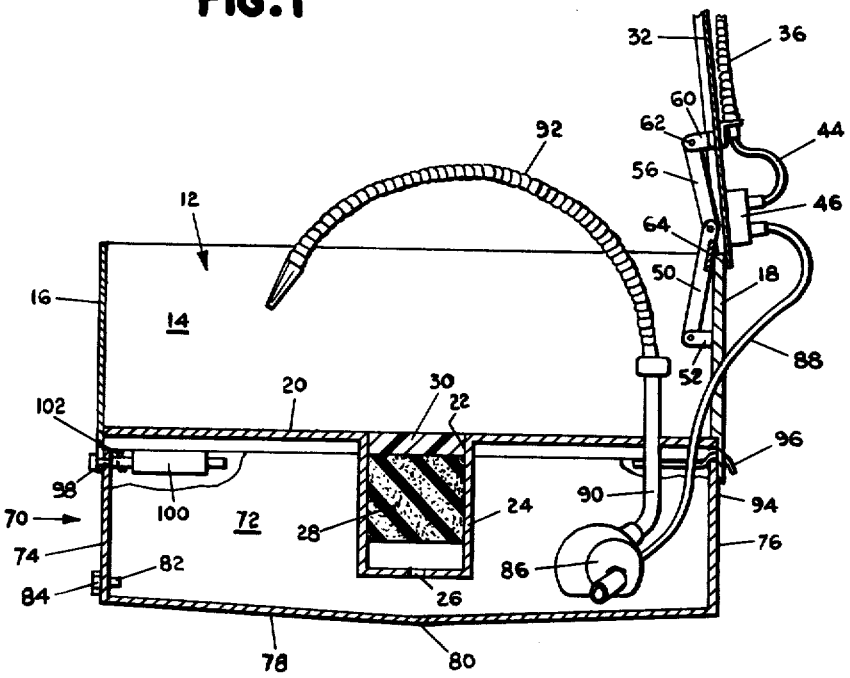
FIG. 2 is a side elevational view of the parts washer in section as seen along lines 2—2 of FIG. 1.

The sidewall 72 of the solvent receptacle 70 is broken away at the upper corners in FIG. 2 to show the hinge bar 94, the sleeves 100 and the latch bar 98. These elements would otherwise not be visible from the view seen in FIG. 2.

A drain tube 82 is provided at the bottom portion of the receptacle bottom wall 78 for draining the solvent as desired from the receptacle 70. A removable plug 84 is threadably attached to the tube 82 to block the passage of the solvent through the tube 82 during normal operation of the parts washer. The solvent receptacle can be easily drained by removal of the plug 84. The receptacle can be tilted for draining and complete cleaning simply by retracting the latch bars 98.

A pump 86 is mounted within the receptacle 70 on a rigid pipe 90. An electrical cord 88 is connected to the pump 86 and to the electrical outlet box 46 to supply electrical current to the pump 86. A flexible conduit 92 is connected to the rigid pipe 90 to supply solvent pumped from pump 86 into the tub 12.

Whereas the invention has been described with reference to a particular solvent receptacle, it should be understood that the invention in some broader aspects contemplates other types of solvent receptacle. For example, the solvent receptacle can be a drum which is positioned beneath the tub 12 in nonsupporting relationship thereto and supported wholly by the floor. Other types of solvent receptacles are within broader aspects of the invention.

Reasonable variation and modification are possible within the scope of the foregoing disclosure and drawings without departing from the spirit of the invention which is defined in the accompanying claims.

The embodiments of the invention in which an exclusive property or privilege is claimed are defined as follows:

1. In a parts washer having a tub, a drain in the tub and a cover hinged to the tub so as to seal the tub when the cover is down, and means for retraining the cover in an open position and for releasing the cover to the sealing position, the improvement in the retaining means comprising:

an overcenter toggle linkage having one end mounted within the tub and another end mounted on the cover, said overcenter linkage having one toggle position bracing the cover in a raised position but slightly tilted forward over the tub and another toggle position permitting closing of the cover over the tub;

said overcenter linkage having at least one fusible link which melts at a relatively low temperature such as that caused by a fire within the tub so that the cover will quickly seal the tub in the event of fire in the tub.

2. A parts washer according to claim 1 wherein the fusible link is a thermoplastic material which melts at about 140° F.

3. A parts washer according to claim 1 wherein the overcenter linkage has a first linkage pivotably mounted on one end to a back wall of the tub and a second linkage pivotably secured at a lower end to an upper end of the first pivotable linkage, and said second linkage at the other end being pivotably mounted to the cover.

4. A parts washer according to claim 3 wherein both the first and second linkages have a relatively low melting point such that the first and second linkages will melt quickly in the event of a fire in the tub.

5. A parts washer according to claim 4 and further comprising a solvent receptacle beneath the tub; means pivotably mounting the solvent receptacle at one end position thereof to the tub; and means for releasably securing the solvent receptacle in a substantially horizontal position beneath the tub; a drain plug at the bottom of the solvent receptacle at an end opposite said one end whereby said solvent receptacle can be quickly and easily drained by removing the drain plug and the releasable retaining means.

6. A parts washer according to claim 5 and further comprising a cylindrical drain tube depending from a bottom wall of the tub, the drain tube having an open top and at least one opening in the bottom thereof, a compressible open-cell foam material removably filling at least cross-sectional areas of the drain tube so that the solvent passes therethrough, said tube extending down into the solvent receptacle so that liquid which drains from the tub filters through the open-cell foam material and into the solvent receptacle.

7. A parts washer according to claim 6 and further comprising a compressible closed-cell foam material removably positioned in the drain tube above the open-cell filter material, said closed-cell foam material being in compressed condition so as to block the flow of fluid through the drain tube as desired.

8. A parts washer according to claim 4 and further comprising a splash plate extending above a back wall of the tub and covering the joint between the back wall and the cover to keep splashed solvent from leaking down through the joint and behind the back wall.

9. In a parts washer having a tub, a drain in the tub and a cover hinged to the tub so as to seal the tub when the cover is down; and means for retaining the cover in an open position and for releasing the cover to the sealing position, the improvement which comprises:

a solvent receptacle beneath the tub;

means pivotably mounting the solvent receptacle at one end portion thereof to said tub;

means releasably securing the solvent receptacle in a substantially horizontal position beneath said tub;

a drain plug at a bottom portion of said solvent receptacle at an end opposite said one end whereby said solvent receptacle can be quickly and easily drained by removing the releasable retaining means and said drain plug.

10. A parts washer according to claim 9 wherein said pivotable mounting means comprises a bar positioned at each side of the rear of the solvent receptacle, said bar extending rearwardly of the solvent receptacle and having a hook; said tub having a depending rear flange at a back portion thereof, openings in said rear flange, and said hooks extending through said holes; and said releasable securing means includes latch bars slidably mounted at the upper front sides of the solvent container;

a depending flange at the front of said tub having holes therethrough aligned with said latch bars such that said latch bars selectively engage said holes.

11. A parts washer according to claim 9 and further comprising a cylindrical drain tube depending from a bottom wall of said tub, said drain tube having an open top and at least one opening in the bottom portion thereof, a compressible open-cell foam filter material removably filling at least the cross-sectional areas of said drain tube so that the solvent material is filtered as it passes therethrough, said cylindrical drain tube extending down into said solvent receptacle so that liquid which drains from said tub filters through said open-cell foam material and into said solvent receptacle.

12. A parts washer according to claim 11 and further comprising a compressible closed-cell foam material removably positioned in said drain tube above the open-cell filter material, said compressible closed-cell foam material being compressed and filling a cross-sectional area of said drain tube so as to block the flow of fluid through the drain tube as desired.

13. A parts washer having a tub, a drain in said tub and a cover hinged to the tub so as to seal the tub when the cover is down; means for retaining the cover in an open position and for releasing the cover to the sealing position; the improvement which comprises:

a cylindrical drain tube depending from a bottom wall of the tub, said drain tube having an open top and at least one opening in the bottom thereof, a compressible open-cell foam material removably filling at least cross-sectional areas of the drain tube so that solvent is filtered by the open-cell filter material as it passes through the drain tube, said drain tube extending down into said solvent receptacle so that liquid which drains from said tube filters through said open-cell foam material and into said solvent receptacle.

14. A parts washer according to claim 13 and further comprising a compressible closed-cell foam material removably positioned in the drain tube above the open-cell material in compressed condition so as to block the flow of fluid through the drain tube as desired.

* * * * *